US005890227A

United States Patent [19]

Brown

[11] Patent Number: 5,890,227

[45] Date of Patent: Apr. 6, 1999

[54] EMT TECHNICIAN VEST

[76] Inventor: Jason C. Brown, 8303 J Bluebird Way, Lorton, Va. 22079

[21] Appl. No.: 563,238

[22] Filed: Nov. 28, 1995

[51] Int. Cl.[6] ..... A41D 1/02

[52] U.S. Cl. ..... 2/102; 2/94; 224/157

[58] Field of Search ..... 2/102, 92, 94, 2/95, 44; 224/157, 158, 159, 160, 184, 265, 266, 268, 269

[56] References Cited

U.S. PATENT DOCUMENTS

| | | | |
|---|---|---|---|
| 620,694 | 3/1899 | Chadwick | 224/157 |
| 1,096,489 | 5/1914 | Chadwick . | |
| 3,258,788 | 7/1966 | Anciaux | 224/157 X |
| 3,486,671 | 12/1969 | Sanders . | |
| 3,561,394 | 2/1971 | Pickens . | |
| 3,659,760 | 5/1972 | Blood | 224/157 |
| 4,272,852 | 6/1981 | Bell . | |
| 4,273,216 | 6/1981 | Weissmann | 2/94 X |
| 4,286,740 | 9/1981 | Knight | 224/157 |
| 4,429,419 | 2/1984 | Snyder . | |
| 4,637,075 | 1/1987 | Ingrisano et al. . | |
| 5,072,456 | 12/1991 | Elin . | |
| 5,274,851 | 1/1994 | Simpkins, Sr. et al. . | |
| 5,301,371 | 4/1994 | Chao . | |
| 5,440,761 | 8/1995 | Abrams et al. . | |
| 5,450,627 | 9/1995 | Grilliot et al. . | |
| 5,516,234 | 5/1996 | Duchesne | 2/102 X |
| 5,544,363 | 8/1996 | McCue et al. | 2/102 |

FOREIGN PATENT DOCUMENTS

| | | | |
|---|---|---|---|
| 74064 | 10/1948 | Norway | 224/184 |
| 3882 | 2/1904 | United Kingdom | 224/157 |
| 2224193 | 2/1990 | United Kingdom | 224/157 |

*Primary Examiner*—C. D. Crowder
*Assistant Examiner*—Shirra L. Jenkins
*Attorney, Agent, or Firm*—Nixon & Vanderhye P.C.

[57] ABSTRACT

A vest, particularly for emergency medical technicians, allows the technician's body to take at least some of the weight of a stretcher carried by the technician, possibly freeing one or both of the technician's hands. The vest has first and second nylon straps extending over its shoulders and attached to the body of the vest, and having adjustable stretcher handle attachments at the free ends of the straps, both in front of and in back of the vest. Horizontal straps of light reflective or luminescent material have closures at their ends and close the open front of the vest. The horizontal straps are adjustable to allow the vest to be tightened securely on the technician's body. A back support of elastic material which is stretched out when the vest is tightened is sewn at its ends to the inside of the vest adjacent the vest lapels.

20 Claims, 3 Drawing Sheets

EMT TECHNICIAN VEST

BACKGROUND AND SUMMARY OF THE INVENTION

Emergency medical technicians ("EMT"), and other types of rescue workers, often have the need to carry stretchers in far from ideal environmental and terrain conditions. This can cause the technician or other worker to lose his or her grip on the stretcher, with significant adverse consequences if that occurs. Also such technicians oftentimes are called upon to lift or carry weights (including loaded stretchers) which are large enough cause back problems for the technician.

According to the present invention a vest is provided for use by an emergency medical technician or other rescue worker which facilitates the technician's proper performance of his or her job under many circumstances. The vest has the ability to support at least some of the weight of the stretcher, freeing the hands of the EMT who is carrying the stretcher so as to stabilize his or her movement through poor environmental conditions and/or rugged terrain. The vest also is capable of supporting the technician's back to minimize the chance of injury as a result of lifting or carrying heavy objects, and at the same time the vest can provide high visibility to the technician in case the technician is working in an area where there is vehicular traffic. The vest achieves these advantages without significantly restricting the EMT's ability to perform othe required tasks.

According to one aspect of the present invention a vest is provided which comprises: A vest body having two arm openings, two shoulders, a neck opening, an open front, and a closed back. First and second straps extending over the shoulders and attached to the body, the straps each having at least one free end at the front or the back of the vest body. And the strap free ends each comprising stretcher handle attachment means, for receiving a stretcher handle to provide support of stretcher handles by the straps.

Closure means are typically provided for closing the open front end of the vest. The closure means may comprise a plurality of body straps extending generally transverse to the shoulder straps and having clasp elements on ends thereof at the open front. Adjustment means for adjusting the positions of the clasp elements are also preferably provided, so that the fit of the vest may be adjusted. Adjustment means are also provided for adjusting the position of the stretcher handle attachment means with respect to the vest body. At least one of the shoulder straps and body straps are preferably of light reflecting or luminescent material (preferably the body straps).

A flexible back support is typically provided connected to the vest body. The vest body may have an open front defined by first and second lapels, the vest body having a first circumference extending from the first lapel to the second lapel. The elastic back support may comprise a flexible elastic strip of material (such as urethane) about 3–6 inches wide (e.g. about 10 centimeters wide) and having an unstretched length at least about an inch less than the first circumference, and connected (e.g. by stitching) to the interior of the vest body adjacent each of the first and second lapels.

The first and second straps preferably have free ends at both the front and back of the vest body, with each of the strap free ends comprising a stretcher handle attachment means. Each of the handle attachment means may comprise a ladder buckle, a strap loop, a metal ring received by the strap loop, and a clamp, such as a carabiner.

According to another aspect of the present invention a vest is provided comprising the following components: A vest body having two arm openings, two shoulders, a neck opening, an open front, and a closed back. The vest body open front is defined by first and second lapels, the vest body having a first circumference extending from the first lapel to the second lapel. And a flexible back support comprising a strip of flexible material about 3–6 inches wide and having an unstretched length at least about one inch less than the first circumference, the strip of flexible material being connected to the vest body interior adjacent each of the first and second lapels. The details of the vest construction preferably are as set forth above.

According to yet another aspect of the present invention a vest is provided particularly for use by emergency medical technicians comprising: A vest body having two arm openings, two shoulders, a neck opening, and an open front, and a closed back. First and second nylon straps extending over the shoulders and attached to the body, the straps each having a free end at each of the front and back of the vest body. And a ladder buckle, strap loop, and metal ring received by the strap loop, for each of the strap free ends.

It is the primary object of the present invention to provide a vest well suited for use by emergency medical technicians and other rescue workers. This and other objects of the invention will become clear from an inspection of the detailed description of the invention, and from the appended claims.

DETAILED DESCRIPTION OF THE DRAWINGS

Figure 1:
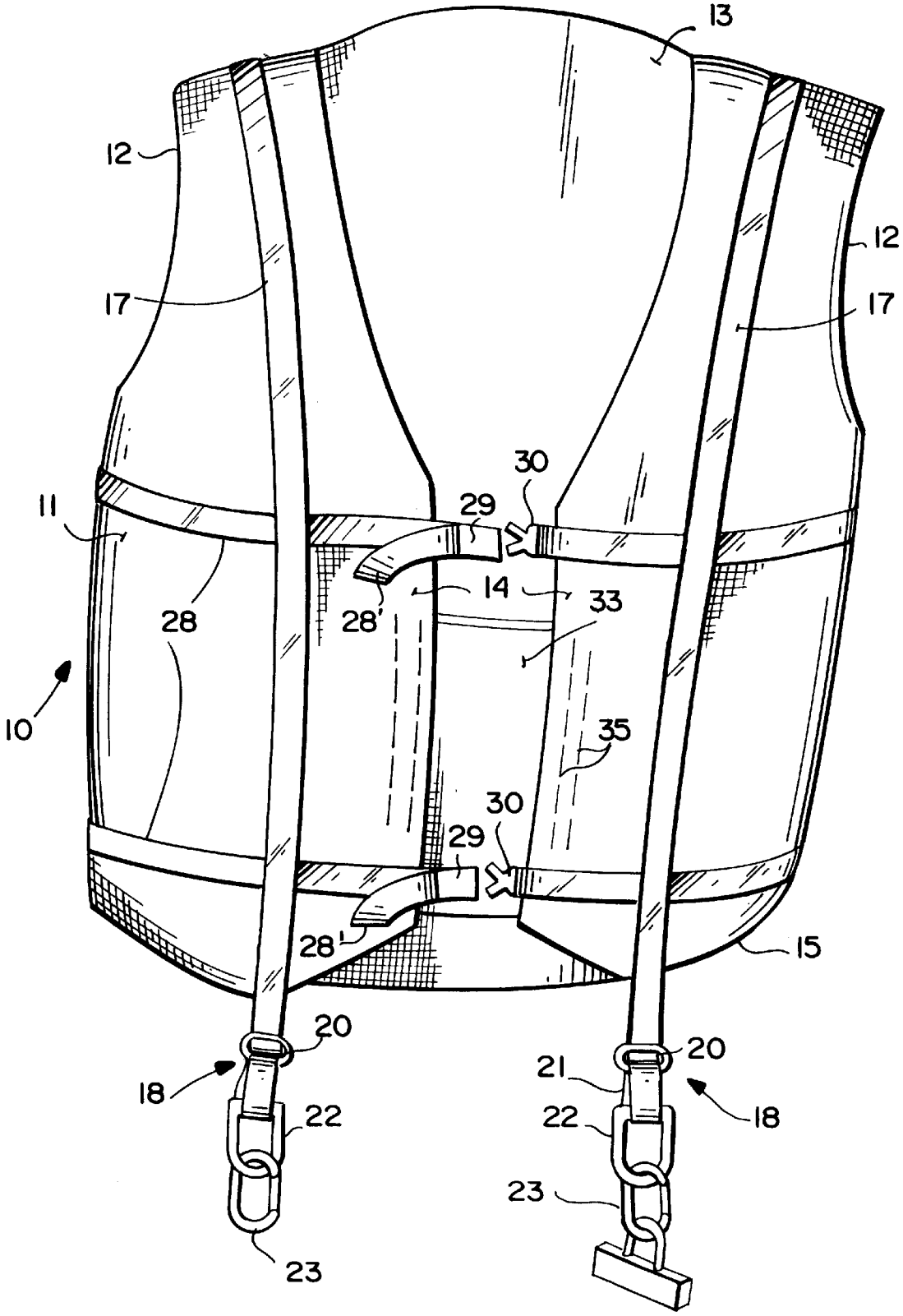
FIG. 1 is a front view of an exemplary emergency medical technician vest according to the present invention.

A vest according to the present invention is shown generally by reference numeral 10 in the drawings. The vest includes a body 11 which may be made of any suitable material, such as nylon, woven cotton, Gortex, woven polyester or aramid, or the like. The material of which the body 11 is made should have the properties of a strong, drapable fabric. The body 11 has two arm openings 12, a closed back 13, an open front defined by lapels 14, a bottom opening defined by the bottom edge 15, and a neck opening.

First and second over the shoulder straps 17 are provided, which are connected to the vest body 11, e.g. by stitching, adhesive, or the like, either at spaced points or along substantially the entire overlapping area thereof. The over the shoulder straps 17 preferably are of strong webbing type material, such as woven nylon, having good tear resistance and durability. At the free ends of the over the shoulder straps 17—preferably at both the front and the rear of the vest body 11—are stretcher handle attachment means, shown generally by reference numeral 18 for the free ends of the strap 17 at the front of the vest body 11 (see FIGS. 1 and 3), and shown generally by reference numeral 19 for the free ends of the straps 17 at the closed back 13 of the vest body 11 (see FIGS. 2 and 3).

A stretcher handle attachment means 18, 19 may be comprised of loops formed of the material of the straps 17 (one or more loops provided at each of the free ends of the straps 17), or of a similar fabric type material; or may comprise metal rings or sleeves, and/or may comprise clamps or hooks, such as carabiners, U-shaped metal hooks, J-hooks, hook and pile (VELCRO) straps, or the like. For the preferred embodiment illustrated in FIGS. 1 through 3, each of the end terminations/attachment means 18 preferably comprises: a ladder lock buckle 20 or a similar mechanism for allowing adjustment of the length of the other elements of the attachments 18 from the bottom 15 of the vest body 11, the straps 17 formed into a strap loop 21 to cooperate with the ladder buckle 20 to effect adjustment of the length; a metal ring 22 received by the fabric loop 21 and extending downwardly therefrom; and a clamp or hook mechanism, such as the carabiner 23. The right side of FIG. 1 schematically illustrates the carabiner 23 being clamped onto a support loop extending upwardly from a stretcher handle, although the carabiner 23 may pass around the stretcher handle itself, or the stretcher may pass therethrough.

Figure 2:
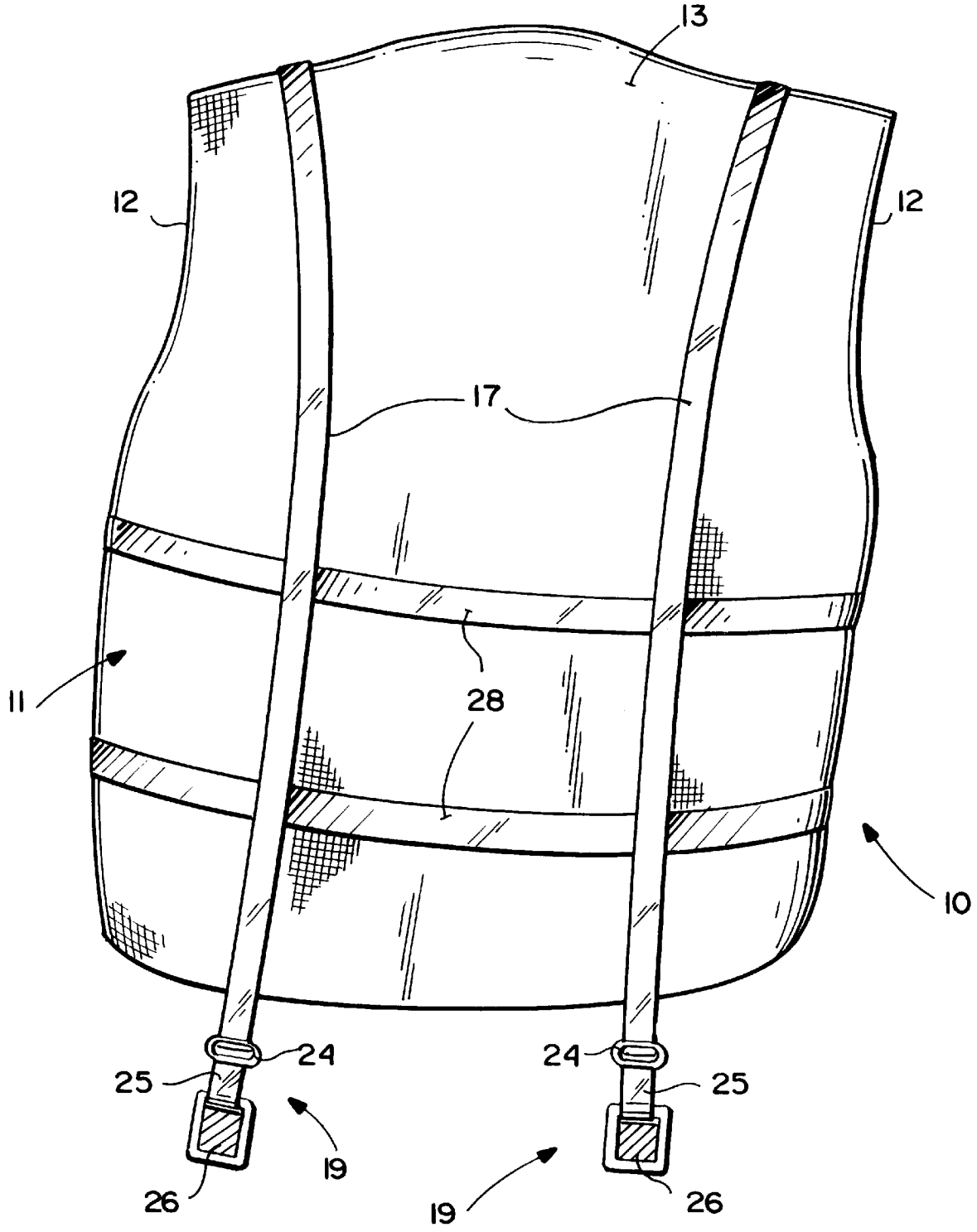
FIGS. 2 and 3 are rear and side views, respectively, of the vest of FIG. 1.
Figure 3:
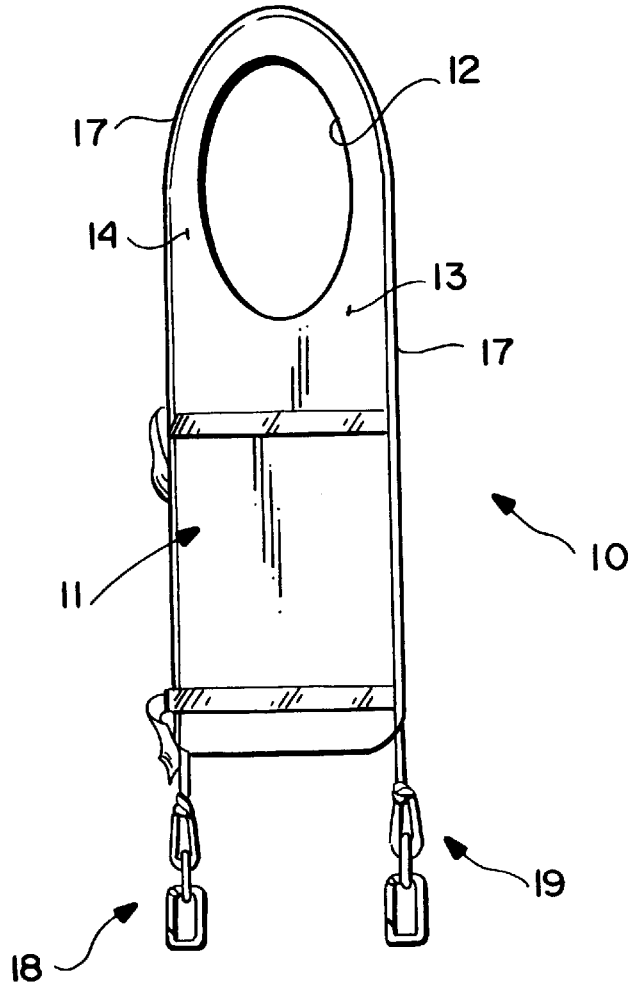

FIG. 2 shows a similar construction for the attachment means 19, showing ladder buckles 24, strap loops 25, and metal rings 26, and in this case the stretcher handles being illustrated schematically as merely fitting within the metal rings 26.

While attachments means 18, 19 may or may not be provided at either the front or rear of the vest body 11, desirably they are provided at both places so that the EMT may utilize them whether leading or following a stretcher while supporting the stretcher. While exemplary components that may be used for stretcher handle attachment have been illustrated and described it is to be understood that virtually any conventional mechanism suitable for that purpose may be utilized.

The vest 10 further comprises a plurality of body straps 28 (typically two, as shown in the drawings) which extend generally transverse to the over the shoulder straps 17, i.e. generally horizontally in use. The straps 28 also typically are of woven nylon or a like sturdy and strong material. The straps 28 may be sewn to the vest body 11, or may merely pass through loops (like belt loops) stitched to the body 11, and may either be attached to the over the shoulder straps 17, or slide with respect thereto. The straps 28, and the closure elements 29, 30 at the free ends thereof, provide closure means for closing the open front of the vest 11 defined by the lapels 14. The closure elements 29, 30 may comprise any conventional closure elements, such as conventional plastic buckles or the like, with the length of the straps 28 being adjustable, as indicated by the free portions 28' thereof illustrated in FIG. 1. Typically the closure elements 29, 30 and the adjustment loops of the straps 28 have a construction like that of a conventional water ski vest.

It is desirable to provide some sort of reflective or luminescent material on the vest 10 in case the technician wearing the vest 10 is working near where there might be vehicular traffic. Instead of providing accessory patches of reflective material, it is desirable to merely form one or more of the straps 17, 28 of reflective or luminescent material. In the preferred embodiment the straps 28 are both made of reflective or luminescent material. Any conventional reflective material can be utilized, such as threads or strands or reflective material sewn into the straps 28, or forming part (e.g. with nylon threads) of the straps 28 themselves, or reflective or luminescent paint or other coating may be provided on the straps 28, etc.

Figure 4:
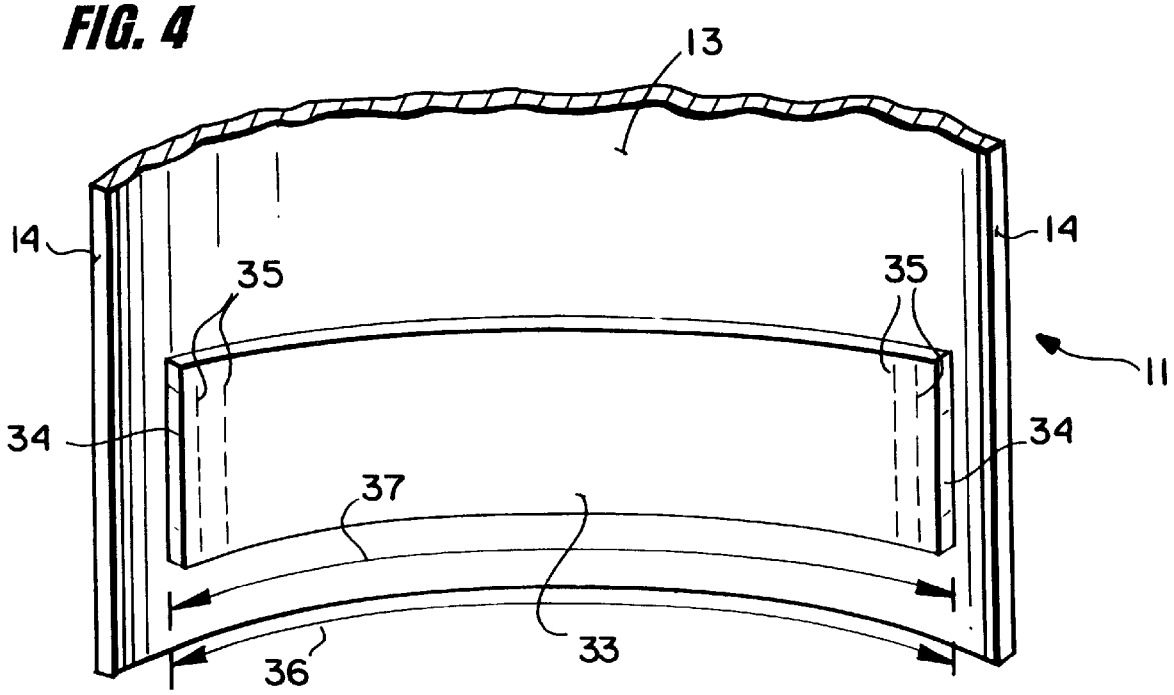
FIG. 4 is a perspective cutaway view of the interior of the vest of FIGS. 1 through 3 showing the back support preferably associated therewith.

In order to provide back support for the wearer of the vest 10 to minimize the potential for back injury from carrying the stretcher and/or lifting or carrying other weights, an elastic back support shown generally by reference numeral 33 (see FIGS. 1 and 4) is provided. The back support 33 preferably comprises a flexible strip of elastic material, such as urethane, rubber, or the like, having free ends 34, and connected adjacent the free ends 34 thereof to the vest body 11 on the interior thereof adjacent the lapels 14, as indicated by the stitching 35 in FIGS. 1 and 4. As seen in FIG. 4 (exaggerated somewhat in relative dimension for clarity of illustration) the dimension 36 of the body 11 from lapel 14 to lapel 14 is significantly greater than the dimension 37 between the ends 34 of the strip 33 when in unstretched condition. Typically the distance 36 is at least about one inch more than the distance 37 so that under normal circumstances when the vest 10 is worn and the straps 28, 28' are tightened, and clasped together by the closure elements 29, 30, the elastic strip 33 is stretched and provides support for 25 the wearer's back at the kidney area. The width of the strip 33 is typically between about 3–6 inches (e.g. about 10 centimeters), and it has a thickness dependent upon the size of the vest 10 and the degree of support necessary.

Fabric loops or other elements may be provided in the vest 10 interior to guide the elastic strip 33, and may insure that it dos not become twisted during storage.

In a typical use of the vest 10, the closures 29, 30 are unlatched from each other, an emergency medical technician or other rescue worker puts his or her arms through the arm openings 12 with the back 13 on the wearer's back, and then the straps 28, 28' are adjusted after the clasps 29, 30 are closed to close the open front of the vest 10. This action stretches the elastic back support 33 so as to provide effective back support to the wearer at the kidney area. If the technician is to be carrying a stretcher or the like, using the buckles 20, 24 or other adjustment structures, and depending upon whether the wearer will be leading the stretcher (with his or her back turned to it) or trailing the stretcher (with his or her front facing it), or both, either (or both) of the front attachment means 18 or the back attachment means 19 will be appropriately adjusted. Then using the rings 22, 26, carabiners 23, or suitable other types of clamps, loops, hooks, or the like, the stretcher handles (or projecting rings therefrom) are properly engaged. This thus provides at least some support for the stretcher, a force being transmitted through the straps 17 to the wearer's entire upper torso, and the straps 17 may either act as a partial support, complete support, or merely a safety mechanism in case the EMT were to drop the stretcher. The reflective or luminescent material associated with the straps 28 provides enhanced safety.

While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent structures and devices.

What is claimed is:

1. A vest comprising:

a vest body having two arm openings, two shoulders, a neck opening, an open front, and a closed back;

first and second straps extending over said shoulders and attache d to said body, said straps each having at least one free end at said front or said back of said vest body said free ends being completely unattached to other portions of said vest thus allowing said free ends to move independently of said vest;

said strap free ends means, for receiving a stretcher handle to provide support of stretcher handles by said straps.

2. A vest as recited in claim 1 further comprising closure means for closing said open front of said vest.

3. A vest as recited in claim 2 wherein said closure means comprises a plurality of body straps extending generally transverse to said shoulder straps, and having clasp elements on ends thereof at said open front.

4. A vest as recited in claim 3 further comprising adjustment means for adjusting the positions of said clasp elements with respect to said body straps so that the fit of said vest may be adjusted.

5. A vest as recited in claim 4 further comprising stretcher attachment means attached to said strap free ends and further comprising adjustment means for adjusting the position of said stretcher handle attachment means with respect to said vest body.

6. A vest as recited in claim 5 further comprising an elastic back-support attached to said vest body.

7. A vest as recited in claim 6 wherein at least one of said shoulder straps and body straps are of light reflecting or luminescent material.

8. A vest as recited in claim 1 wherein said vest body open front is defined by first and second lapels, said vest body having a first circumference extending from said first lapel to said second lapel; and wherein said elastic back support comprises a flexible strip of elastic material about 3–6 inches wide and having an unstretched length at least about one inch less than said first circumference, and wherein said strip of elastic material is connected to the interior of said vest body adjacent each of said first and second lapels.

9. A vest as recited in claim 1 wherein said first and second straps each have distinct free ends at both said front and said back of said vest body; and wherein each of said distinct strap free ends comprises stretcher handle attachment means, two of said stretcher handle attachment means attached to a stretcher handle.

10. A vest as recited in claim 9 further comprising adjustment means for connecting each said handle attachment means to its corresponding strap to adjust the position of said handle attachment means with respect to said vest body.

11. A vest as recited in claim 10 wherein each of said handle attachment means includes a metal ring and a clamp connectable to said ring.

12. A vest as recited in claim 11 wherein said clamps comprise carabiniers.

13. A vest as recited in claim 3 wherein said body straps are of light reflective or luminescent material.

14. A vest comprising:

a vest body having two arm openings, two shoulders, a neck opening, an open front, and a closed back;

said vest body open front defined by first and second lapels and said vest body having a first circumference extending from said first lapel to said second lapel; and an elastic back support comprises a flexible strip of elastic material about 3–6 inches wide and having an unstretched length at least about one inch less than said first circumference, and said strip of elastic material connected to said vest body adjacent each of said first and second lapels.

15. A vest as recited in claim 14 further comprising closure means for closing said open front of said vest.

16. A vest as recited in claim 15 wherein said closure means comprises a plurality of body straps extending generally transverse to said open front, and having clasp elements on ends thereof at said open front.

17. A vest as recited in claim 16 further comprising adjustment means for adjusting the positions of said clasp elements with respect to said body straps so that the fit of said vest may be adjusted.

18. A vest as recited in claim 16 wherein said body straps are of light reflective or luminescent material.

19. A vest as recited in claim 14 wherein said strip of elastic material comprises urethane, and is connected to said vest body by stitching.

20. A vest comprising:

a vest body having two arm openings, two shoulders, a neck opening, an open front, and a closed back;

first and second nylon straps extending over said shoulders and attached to said body, said straps each having a free end at each of said front and back of said vest body distinct from said other strap and other free ends; and a ladder buckle, strap loop, and metal ring received by said strap loop, for each of said strap free ends.

* * * * *